US007229315B2

(12) United States Patent
Zhang et al.

(10) Patent No.: US 7,229,315 B2
(45) Date of Patent: Jun. 12, 2007

(54) ELECTRICAL CONNECTOR HAVING A SHIELDING SHELL

(75) Inventors: Chi Zhang, Kunsan (CN); Ren-Chih Li, Tu-Chen (TW); Guojian Shen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,605

(22) Filed: Jun. 27, 2005

(65) Prior Publication Data

US 2006/0121781 A1 Jun. 8, 2006

(30) Foreign Application Priority Data

Dec. 3, 2004 (TW) ..... 93219489 U

(51) Int. Cl.
*H01R 13/648* (2006.01)

(52) U.S. Cl. ..... 439/607; 439/60; 439/637

(58) Field of Classification Search ..... 439/607, 439/79, 60, 637
See application file for complete search history.

(56) References Cited

U.S. PATENT DOCUMENTS 4,869,672 A * 9/1989 Andrews Jr. ..... 439/60
5,035,631 A * 7/1991 Piorunneck et al. ..... 439/108
6,315,616 B1 11/2001 Hayashi
6,821,158 B2 * 11/2004 Iida et al. ..... 439/660
6,913,488 B2 * 7/2005 Motojima et al. ..... 439/607

* cited by examiner

*Primary Examiner*—X. Chung-Trans
(74) *Attorney, Agent, or Firm*—Wei Te Chung

(57) ABSTRACT

A connector including a housing (10) having a pair of opposing walls (110, 120) defining a mating slot (100) therebetween; a shell (20) enclosing the housing and having at least a grounding leg (211) for being grounded to a printed circuit board (PCB); a plurality of signal terminals (40) each having a retaining portion (410) retained in the housing, a deflectable contact beam (420) formed with a contact point (421) and extending into the mating slot along one of said opposing walls (110), and a solder tail (430) to be soldered to the PCB; and a conductive means (30) retained in the housing and having at least a deflectable contact finger (320) partly accommodated in the other of said opposing walls (120) and formed with a first contact point (321) protruding towards the contact point of said signal terminal and a second contact point (322) protruding for contacting the shell.

11 Claims, 6 Drawing Sheets

ELECTRICAL CONNECTOR HAVING A SHIELDING SHELL

BACKGROUND OF THE INVENTION

1. Field of the Invention

The present invention relates to an electrical connector, and more particularly to an electrical connector having a shell for preventing EMI (Electro-Magnetic Interference).

2. Description of Related Art

U.S. Pat. No. 6,315,616 discloses a socket connector for connecting a plug connector which receives a flexible printed circuit (FPC) therein to a printed circuit board (PCB) and therefore connecting the FPC to the PCB. The disclosed connector comprises an insulative housing, a plurality of signal terminals, a grounding plate, and a shell for shielding, and forms a plug connector fitting section constituted by a pair of opposing walls wherein the upper wall is formed by an upper plate extending from the upside of an elongated base of the housing and the lower wall is formed by the shell. The signal terminals are arranged and retained in the base of the housing and each has a contact beam extending forwards in the plug connector fitting section along the inner surface of the upper wall and a solder tail extending rearwards beyond the housing to be soldered onto the PCB. The grounding plate attached in the housing comprises a plurality of elastic contact pieces extending forwards in the plug connector fitting section along the inner surface of the lower wall and a plurality of solder legs extending rearwards to align with the solder tails of the sign terminals and thus to be soldered onto the PCB together with them. Those solder tails and solder legs are arranged in such a fashion that the solder tails appear in pairs and between every two pairs of the solder tails lies a solder leg of the grounding plate.

However, as the lower wall of the plug connector fitting section is formed by the thin shell, the strength thereof is not enough. Thus the lower wall may be humped up while the plug connector fitting section is plugged. Furthermore, the alternate arrangement of the solder legs and the pairs of solder tails decreases the density of the signal terminals in the connector. That can't meet the miniaturization requirement for electrical components.

Therefore, it is desired to provide an improved connector to overcome the disadvantages of the prior arts.

SUMMARY OF THE INVENTION

An object of the present invention is to provide a connector in which a plug connector fitting section is provided with a reliable strength.

Another object of the present invention is to provide a connector minimized in size.

In order to achieve above-mentioned objects, a connector of the present invention includes an insulative housing having a pair of opposing walls defining a mating slot therebetween; a shell including a pair of shielding walls respectively attached to peripheries of said opposing walls of the housing and at least a grounding leg adapted to be soldered to a printed circuit board (PCB); a plurality of signal terminals each having a retaining portion retained in the housing, a deflectable contact beam formed with a contact point and extending into the mating slot along one of said opposing walls, and a solder tail adapted to be soldered to the PCB; and a conductive means having a retaining portion retained in the housing and at least a deflectable contact finger partly accommodated in the other of said opposing walls, said deflectable contact finger formed with a first contact point protruding towards the contact point of said signal terminal and a second contact point protruding for contacting the shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
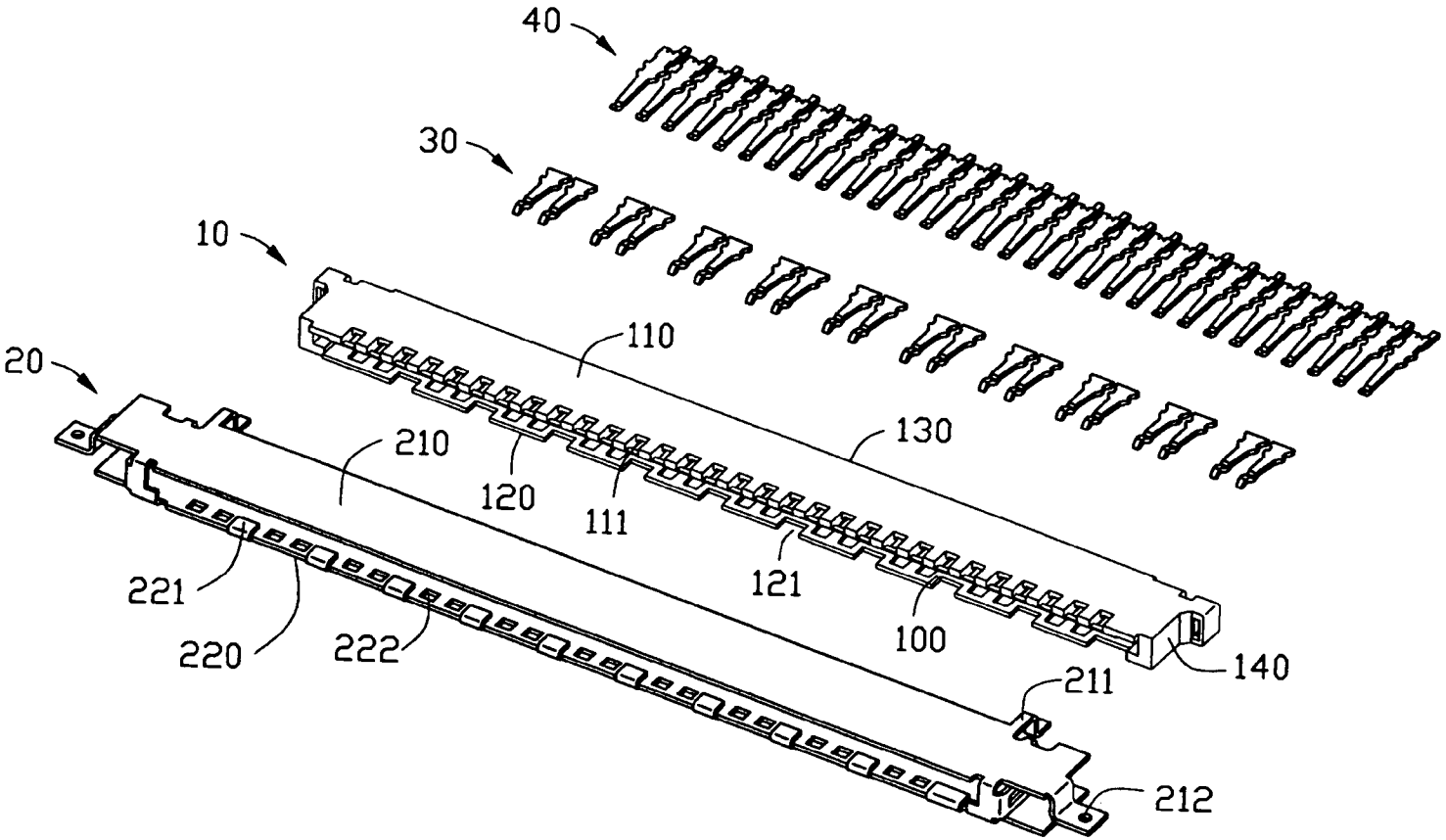
FIG. 1 is an exploded perspective view of a connector in accordance with the preferred embodiment of the present invention.

Reference will now be made to the drawing figures to describe the preferred embodiment of the present invention in detail.

Figure 2:
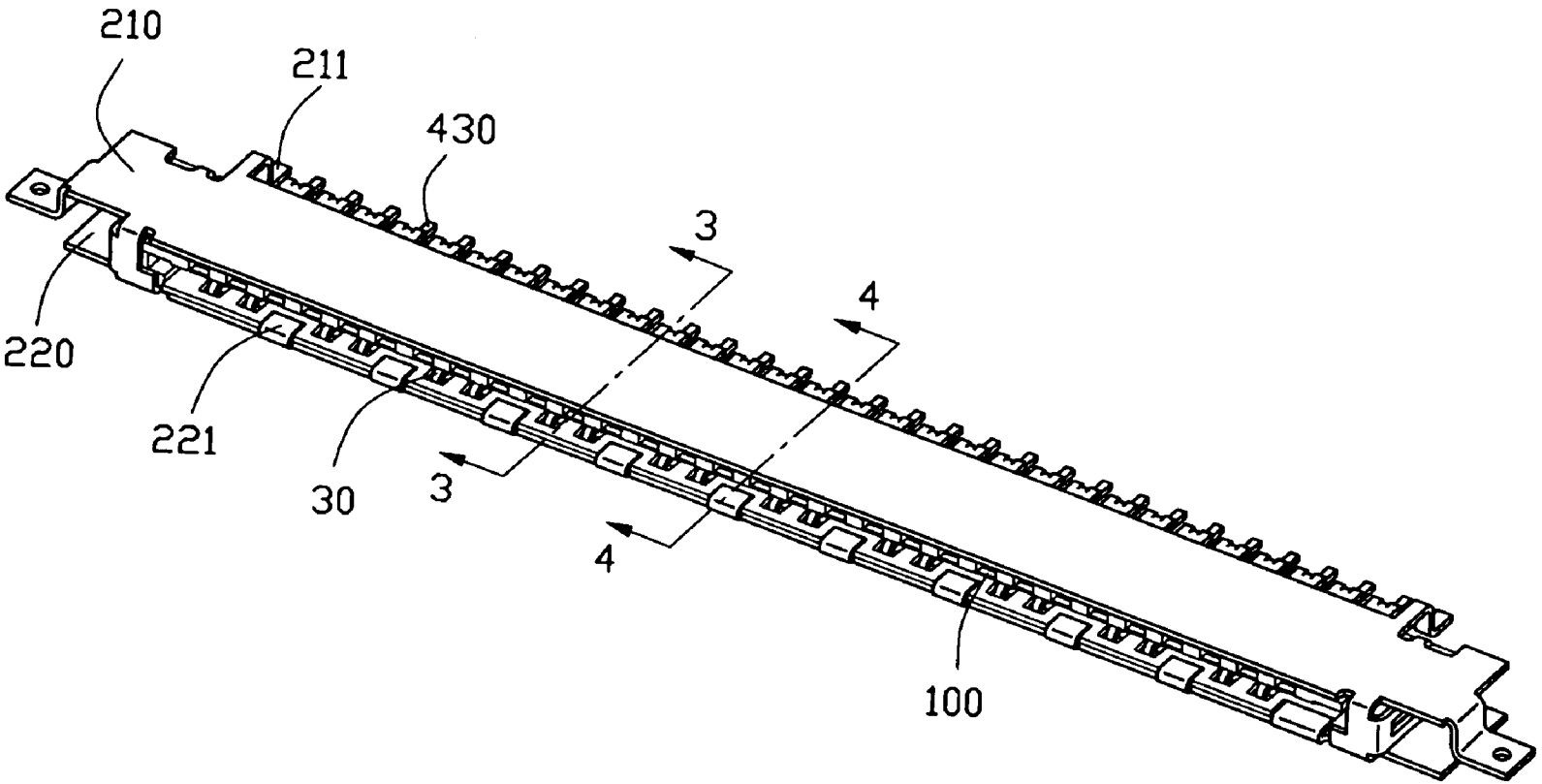
FIG. 2 is an assembled perspective view of the connector of FIG. 1.

Referring to FIGS. 1 and 2, a connector in accordance with the present invention includes a longitudinal housing 10, a shell 20 attached on a periphery of the housing 10, a plurality of signal terminals 40 and a plurality of elastic terminals 30 respectively loaded in the housing 10. The housing 10 comprises a rear base 130, an upper wall 110 and a lower wall 120 extending forwards from the rear base 130, and a pair of side walls 140 respectively connecting the upper wall 110 and the lower wall 120. The upper wall 110, the lower wall 120 and the side walls 140 cooperate to constitute a plug connector fitting section with a mating slot 100 therein for receiving a plug connector 50 (shown in FIG. 5).

Figure 3:
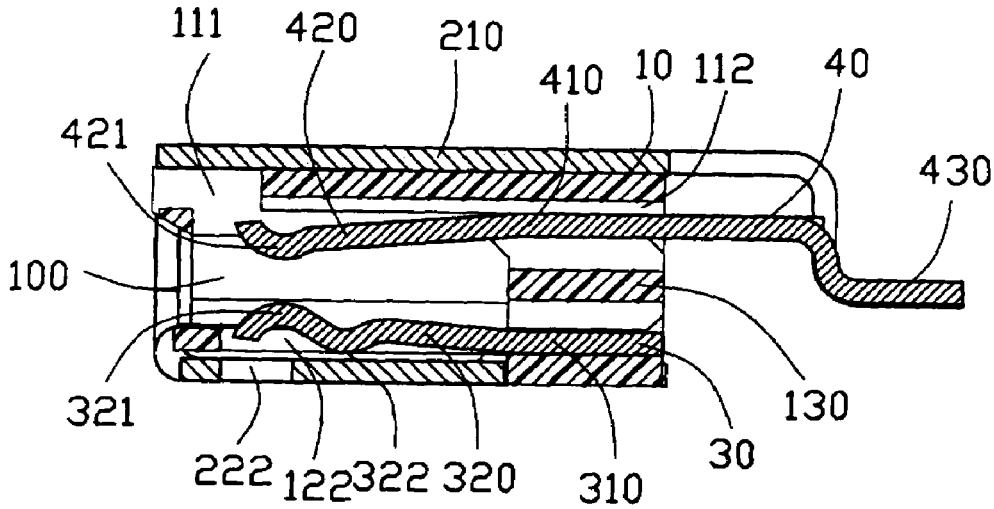
FIG. 3 is a cross-sectional view taken along the line 3—3 in FIG. 2.

Referring to FIGS. 1 and 3, the upper wall 110 defines a row of upper channels 112 on its inner face for accommodating the signal terminals 40. Each upper channel 112 runs along a front-to-back direction that is an insertion direction of the plug connector, and extends rearwards throughout the rear base 130 and forwards to communicate with a cutout 111 which is formed at the front end of the upper wall 110 for providing a space for deflection of a free end of the signal terminal 40 (which will be described in detail hereafter), as can be best seen in FIG. 3. The signal terminal 40, which comprises a retaining portion 410, a contact beam 420 extending forwards from the retaining portion 410 and a solder tail 430 extending rearwards from the retaining portion 410, is assembled into the upper channel 112 from the rear base 130 with the contact beam 420 thereof projecting into the mating slot 100, the retaining portion 410 retained in the rear base 130, and the solder tail 430 remained behind the rear base 130 to be soldered to a printed circuit board (PCB). The contact beam 420 is formed with a downwards protruding contact point 421 at a free end thereof.

Similarly, the lower wall 120 defines a row of lower channels 122 for accommodating the elastic terminals 30. The lower channel 122 also extends throughout the rear base 130 along the front-to-back direction, but unlike the upper channel 112, a front section of the lower channel 122 in front of the rear base 130 is a through aperture throughout the lower wall 120 along a thickness direction. The elastic terminal 30 which is assembled into the lower channel 122 from the rear base 130 comprises a retaining portion 310 retained in the rear base 130 and a contact beam 320 extending forwards to be accommodated in the through aperture in the lower wall 120. The contact beam 320 is formed with a first contact point 321 at its front end and a second contact point 322 closely following in the rear of the first contact point 321. Wherein the first contact point 321 upwardly protrudes towards the contact point 421 of the signal terminal 40 but the second contact point 322 protrudes downwardly quite the contrary.

Figure 4:
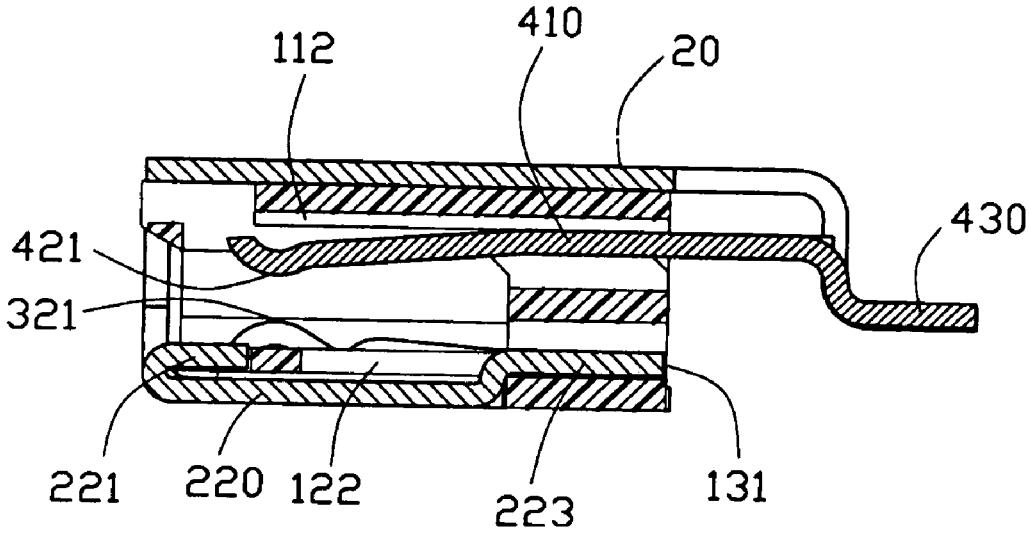
FIG. 4 is a cross-sectional view taken along the line 4—4 in FIG. 2.
Figure 6:
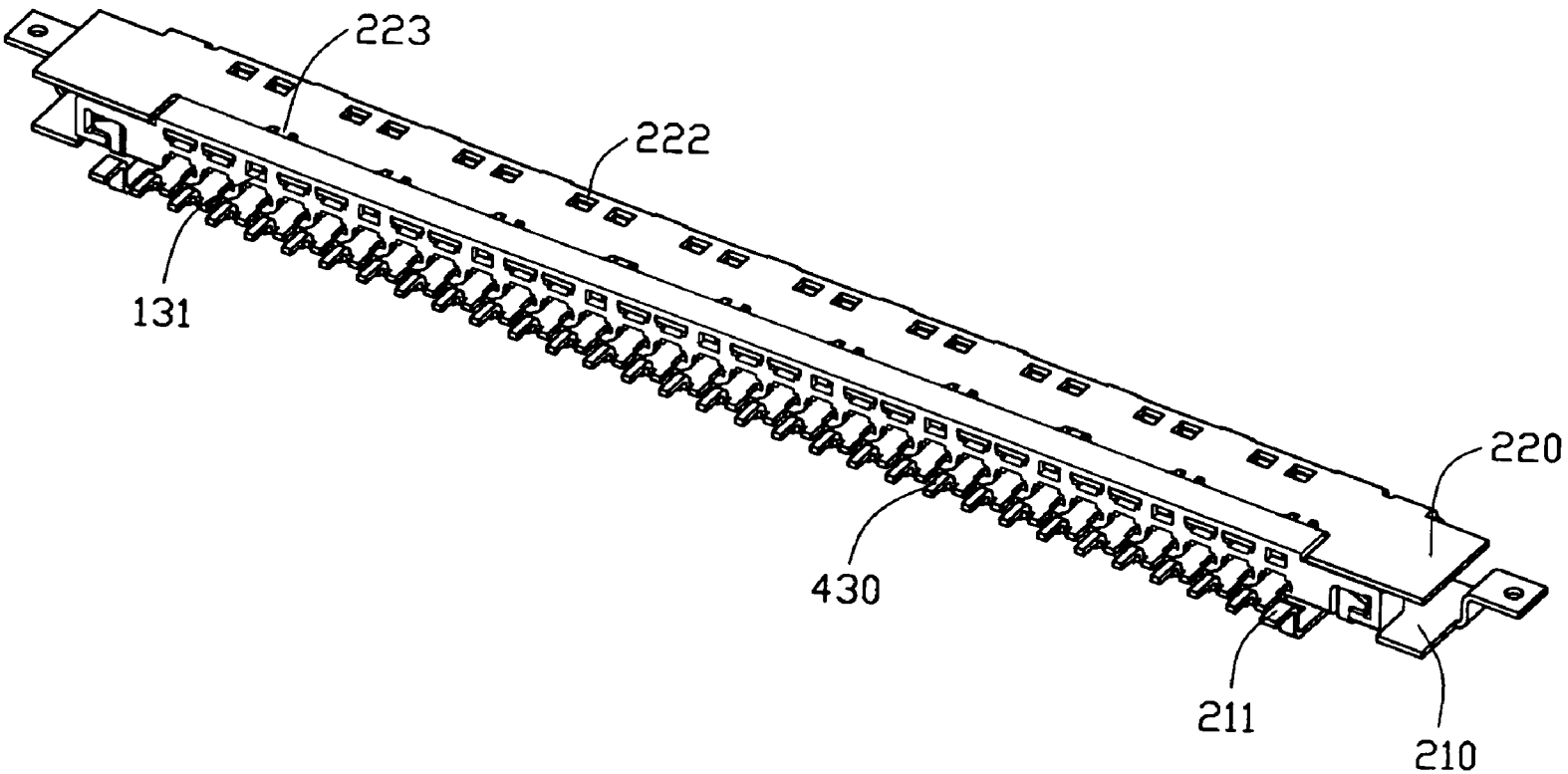
FIG. 6 is an assembled perspective view similar to FIG. 2 but taken from another aspect.

The shell 20 is a rectangular annularity comprising an upper shielding wall 210, a lower shielding wall 220, and a pair of side shielding walls (not labeled) respectively for shielding the upper wall 110, the lower wall 120, and the sidewalls 140 of the housing 10. Corresponding to the first contact points 321 of the elastic terminals 30, the shell 20 defines a plurality of through slot 222 in the lower shielding wall 220 thereof. As best shown in FIG. 3, the through slot 222 can provide a space for deflection of the fist contact points 321 of the elastic terminals 30. The shell 20 further has a plurality of bend pieces 221 turned back from the front edge of the lower shielding wall 220 to be correspondingly received in cutouts 121 defined at the front of the lower wall 120 of the housing 10, and a plurality of retaining legs 223 (shown in FIGS. 4 and 6) extending rearwards from the rear edge of the lower shielding wall 220 to be correspondingly retained in holes 131 defined in the rear base 130. Via those bend pieces 221 and retaining legs 223, the shell 20 can be reliably attached on the housing 10. In addition, the upper shielding wall 210 is formed with a pair of grounding legs 211 extending rearwards form the rear edge thereof and a pair of lock ears 212 extending sidewards from the longitudinal ends thereof respectively. Both the grounding legs 211 and the lock ears 212 will be soldered onto the PCB respectively for the purpose of grounding the shell 20 to the PCB and locking the assembled connector to the PCB. As best shown in FIGS. 2 and 6, when the shell 20 is assembled on the housing 10, the grounding legs 211 are respectively placed at two ends of a row formed by the solder tails 430 of the signal terminals 40 which have to be soldered to the PCB as well, and align with the solder tails 430 for facilitating the soldering operation.

Figure 5:
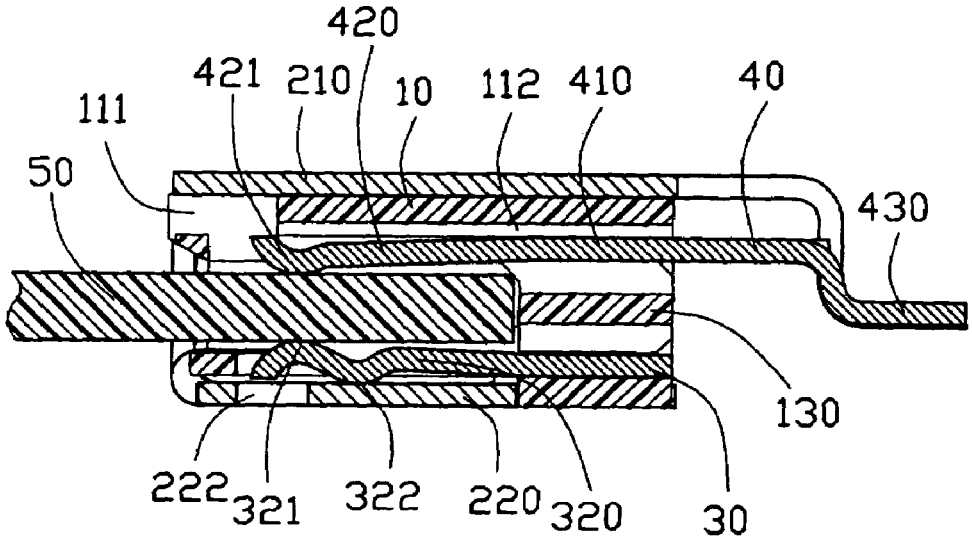
FIG. 5 is a cross-sectional view similar to FIG. 4 showing the connector being plugged.

As shown in FIG. 3, the second contact point 322 of the elastic terminal 30 do not contact the lower shielding wall 122 of the shell 20 before the connector is plugged. After the connector is plugged, as shown in FIG. 5, a mating section 50 of a plug, which is inserted into the mating slot 100 between the contact points 421 of the signal terminals 40 and the first contact points 321 of the elastic terminals 30, presses the contact beam 420 and the contact beam 320 respectively to do an upward deflection and a downward deflection. Therefore the second contact point 322 is pressed to contact the lower shielding wall 220 of the shell 20 to switch on a grounding path from the elastic terminals 30 to the shell 20, and finally to the PCB via the grounding legs 211. Such a grounding path occupies rather little space in the connector and thus meets the minimization requirement for electrical components.

Additionally, as in assembly, the shell 20 is attached on the periphery of the housing 10, thus the plug connector fitting section constituted by the upper wall 110 and the lower wall 120 of the housing 10 is strengthened by supports of the upper shielding wall 210 and the lower shielding wall 220 of the shell 20. That is to say, the pressure from the plug connector inserted into the plug connector fitting section is taken on by the housing 10 and the shell 20 together. Therefore either the lower wall 120 of the housing or the lower shielding wall 220 is prevented from being humped up by the plug connector. Otherwise, as the contact beam 320 is accommodated in the through aperture 122 of the lower wall 120, a thickness space in the connector for the elastic terminals 30 is saved.

However, the disclosure is illustrative only, changes may be made in detail, especially in matter of shape, size, and arrangement of parts within the principles of the invention. For example, the elastic terminals 30 would be replaced by a metal plate formed with a plurality of elastic tongues that are equivalent to the contact beams 320 of the elastic terminals 30. Further, the lower wall 120 of the housing 10 can be eliminated from the connector since the elastic terminals 30 which are retained in the housing 10 can take on some of the pressure from the plug connector 50 inserted into the plug connector fitting section and therefore the shell 20 can be prevented from being humped up.

What is claimed is:

1. A connector comprising:

an insulative housing having a pair of opposing walls defining a mating slot therebetween;

a shell enclosing the housing and provided with at least a grounding leg adapted to be soldered to a printed circuit board (PCB);

a plurality of signal terminals loaded in the housing and each having a deflectable contact beam formed with a contact point and extending into the mating slot along one of said opposing walls, and a solder tail adapted to be soldered to the PCB; and a conductive means retained in the housing and having at least a deflectable contact finger partly accommodated in the other of said opposing walls, said deflectable contact finger formed with a first contact point protruding towards the contact point of said signal terminal and a second contact point distanced from the shell and contacting with the shell when the deflectable contact finger is urged; wherein the conductive means is a row of separate elastic terminals each with a said deflectable contact finger, wherein each said deflectable contact finger is a row of separate elastic terminals each with a said deflectable contact finger; wherein each said deflectable contact finger is accommodated in a through aperture defined in said other opposing wall; wherein the conductive means has no solder tail for mechanically and electrically connected with the PCB.

2. The connector as claimed in claim 1, wherein said first contact point is positioned at a front end of the contact finger, and said second contact point follows in the rear of said first contact point.

3. The connector as claimed in claim 1, wherein when the mating slot is inserted with a complementary, the complementary contacts the first contact point and deflects the deflectable contact finger outwardly to make the second contact point contact the shell.

4. The connector as claimed in claim 1, wherein said solder tails of the signal terminals are arranged in a row, said at least a grounding leg of the shell is a pair of grounding legs respectively positioned at two opposite ends of said row.

5. An electrical connector comprising:

an insulative housing defining opposite first and second walls with a mating cavity therebetween; the first and second walls respectively defining a row of channels thereon;

a plurality of first terminals disposed in the first wall of the housing and including a first contact portion extending into the mating cavity toward the second wall;

a plurality of second terminals disposed in the second wall of the housing and including a second contact portion extending into the mating cavity toward the first wall; and a discrete metallic shield enclosing the housing; wherein a front section of the channels of the second wall is a through aperture run throughout the second wall along a thickness direction; wherein the first terminal defines a solder tail for electrically and mechanically connecting to a printed circuit board while the second terminal has no unitary solder tail for directly mechanically and electrically connecting to the printed circuit board but via the shield which has a solder leg for electrically and mechanically connecting to the printed circuit board.

6. The electrical connector as claimed in claim 5, wherein said second terminal is not engaged with the shield until a complementary is inserted into the mating cavity.

7. The electrical connector as claimed in claim 5, wherein said shield defines a plurality of openings so as to receive distal ends of the second terminals when said second terminals are outwardly deflected by the complementary connector.

8. The electrical connector as claimed in claim 5, wherein said shield includes a plurality of retaining legs arranged in an offset manner to be located in an inner position and level with the second terminals rather than being exposed to an exterior.

9. An electrical connector comprising:

an insulative housing defining opposite first and second walls with a mating cavity therebetween; the first and second walls respectively defining a row of channels thereon;

a plurality of first terminals disposed in the channels of the first wall of the housing and including a first contact portion extending into the mating cavity toward the second wall;

a plurality of second terminals disposed in the channels of the second wall of the housing and including a second contact portion extending into the mating cavity toward the first wall; and a metallic shield enclosing the housing; wherein a front section of the channels of the second wall is a through aperture run throughout the second wall along a thickness direction, the second terminals are mechanically and electrically connected with the shell at least during a mating process; wherein the shell defines cutouts corresponding to distal ends of the second contact portions of the second terminals; wherein the first terminals include solder tails arranged in a row for mechanically and electrically connecting to the printed circuit and the second terminals has not solder tails for mechanically and electrically connecting to the printed circuit.

10. The electrical connector as claimed in claim 9, wherein the shell has a pair of grounding legs arranged the same row of the solder tails of the first terminals.

11. The electrical connector as claimed in claim 9, wherein the second wall is located generally in alignment with the second terminals in a mating direction and does not extend outwardly beyond the second terminals in a transverse direction perpendicular to said mating direction.

* * * * *